US005603360A

United States Patent [19]

Teel

[11] Patent Number: 5,603,360

[45] Date of Patent: Feb. 18, 1997

[54] METHOD AND SYSTEM FOR TRANSPORTING NATURAL GAS FROM A PIPELINE TO A COMPRESSED NATURAL GAS AUTOMOTIVE RE-FUELING STATION

[76] Inventor: James R. Teel, P.O. Box 208, Bull Shoals, Ark. 72619

[21] Appl. No.: 454,531

[22] Filed: May 30, 1995

[51] Int. Cl.[6] ..... B65B 1/04

[52] U.S. Cl. ..... 141/21; 141/18; 141/25; 141/114; 141/231; 222/389; 137/267

[58] Field of Search ..... 141/18, 114, 25, 141/26, 28, 39, 67, 82, 98, 231, 21; 222/386.5, 389, 95, 105, 146.5; 137/267

[56] References Cited

U.S. PATENT DOCUMENTS 3,493,496 2/1970 Bray et al. ..... 222/386.5
5,107,906 4/1992 Swenson et al. ..... 141/82
5,211,021 5/1993 Pierson ..... 141/82
5,253,682 10/1993 Haskett et al. ..... 141/67
5,301,723 4/1994 Goode ..... 141/82

*Primary Examiner*—David J. Walczak
*Assistant Examiner*—Steven O. Douglas

[57] ABSTRACT

A system for delivering natural gas, from a pipeline, is loaded onto a movable transport by flowing the gas into multiple pressure vessels equipped with internal flexible bladders which will contain the gas until the pressure in the vessels equalize with the pressure in the pipeline. At that time, the transport will be moved to a compressed natural gas (CNG) re-fueling station. At the re-fueling station, the multiple pressure vessels will be connected to an un-loading conduit leading to the storage facilities. The natural gas will be un-loaded by pressure differential until pressures equalize, then pressurized hydraulic fluid will be pumped into the annulus between the bladder and the steel walls of the pressure vessel which will deflate the bladder and squeeze the remaining gas out of the bladder to storage. The transport is then disconnected from the un-loading facilities and returned to the pipeline for re-filling with natural gas.

6 Claims, 3 Drawing Sheets

METHOD AND SYSTEM FOR TRANSPORTING NATURAL GAS FROM A PIPELINE TO A COMPRESSED NATURAL GAS AUTOMOTIVE RE-FUELING STATION

BACKGROUND OF THE INVENTION

1. Field of the Invention

The present invention relates generally to a method and a system for transporting natural gas between a natural gas pipeline and a compressed natural gas (CNG) station for the purpose of re-fueling automobiles, busses, and trucks, and other end-user uses. More particularily, it relates to such a method and system especially adapted to the economies involved with re-fueling stations that are remote from a pipeline where the cost of constructing a conventional pipeline extension to a re-fuel station site is excessive, (or extension is impractical due to regulations or other factors). These remote station sites must rely upon trucks and transport vessels to bring natural gas to the station site in steel tubes. The present invention relates, specifically, to the use of a flexible bladder to accept gas from the pipeline, hold the gas under pressure inside the outer steel transport vessel until the vessel reaches the station site, at which time the gas is un-loaded to storage by deflating the bladder. The deflation process will be accomplished by pumping a hydraulic fluid into the annulus between the bladder and the walls of the steel vessel. Without the presence of an internal flexible bladder, the vessel would have to be un-loaded with the assistance of an expensive compressor, which would increase the cost of delivery of natural gas to the re-fuel site and make it more difficult for natural gas to compete with gasoline and diesel as the primary fuel for autos, busses, and trucks.

2. Description of the Prior Art

The use of compressed natural gas (CNG) as fuel for automobiles, busses and trucks, has been known for many years, and is in use in many areas of the world. The conventional manner for handling the natural gas is to transport the gas, by truck-mounted high-pressure vessels, from a pipeline to re-fueling stations. While the system has proven successful, in many instances, the economic costs are so excessive as to make the use of natural gas non-competitive with conventional fuels such as gasoline and diesel.

In recent years, environmental-pollution concerns in many areas of the United States have focused attention on the use of alternative fuels, i.e., fuels for automobiles, busses, and trucks that emit less pollutants to the air than gasoline and diesel fuel currently in use. One of the least-polluting fuels is natural gas, which is being given a high priority by government and industry due to it's easy access and long term availability. The chief obstacle to a massive conversion from gasoline and diesel to compressed natural gas (CNG) is the cost to deliver CNG to a re-fueling station from the nearest natural gas pipeline. The industry is currently utilizing high-pressure tube-trailers (which were developed for other uses as described in U.S. Pat. Nos. 4,139,019, 4,213,476, and 4,380,242.) These tube-trailers are expensive to operate and have limited availability. One of the higher costs in using the high-pressure tube-trailers is that they must utilize an expensive compressor to un-load the gas when it arrives at the re-fueling station. It has also been demonstrated that natural gas can be liquified and stored in refrigerated vessels for transportation, as described in U.S. Pat. No. 3,232,725. The method requires refrigeration equipment and insulation to hold the gas in a sub-freezing temperature during transportation. The high cost of a liquification plant, in addition to the extra weight and space requirements under the method, makes it excessively expensive compared to the costs of gasoline and diesel, and much more excessively expensive as compared to compressed (not liquified) natural gas.

The present invention is intended to solve the need for economically transporting natural gas from remote pipelines to re-fueling stations. It is particularily designed to operate in a low-pressure (1000 psi) environment, compared to other equipment operating in a high-pressure environment (2400–3600 psi). Reduction of the system operating pressure to approximately 1000 psi will enable the transport vessel (with enclosed bladder) to accept gas at pipeline pressure, without additional compression, and transport the gas to a re-fueling station at approximately 1000 psi, where it can be off-loaded into storage by deflating the bladder with pressurized hydraulic fluid pumped into the annulus between the outside of the bladder and the inside walls of the steel transport vessel, which will deflate the bladder. Deflation of the bladder will force, or squeeze, the gas out of the bladder and into storage.

The present invention is particularily designed for economically transporting the natural gas over-the-road, and in this embodiment makes use of the general type of transport motor vehicles that have been developed for handling specialty gases (such as oxygen, acetylene, and natural gas) utilizing semi-trailers with a number of cylindrical high-pressure vessels. The modification of the method used to evacuate natural gas into storage, i.e., the deflating of the internal bladder with hydraulic fluid pressure, instead of using a multi-stage compressor which would be necessary in the absence of an internal bladder, reduces the total cost to move the gas from the pipeline to the re-fuel station, thereby making compressed natural gas (CNG) competitive with gasoline and diesel as the primary fuel for automobiles, busses, and trucks.

While the invention is primarily intended for transporting natural gas over-the-road, it can also be adapted for transportation by other means such as by barge, rail, or airplane. When these transport vehicles are employed, the elimination of the need for refrigeration equipment or high-pressure compression equipment will allow carrying a significantly heavier payload. It can also serve as a more economical method of transporting natural gas from isolated gas wells to a pipeline for sale, or, in some instances, for sale directly to a re-fueling station.

SUMMARY OF THE INVENTION

In the method and system of the invention, a first terminal is built at a convenient pipeline exit location on the out-skirts of a populated area containing (or proposed to contain) a number of re-fuel stations which are scheduled to be served by receiving natural gas from the nearest pipeline. The first terminal will consist of one or more loading manifolds, volume meters, pressure and flow regulators, and a line-heater as may be necessary to prevent the formation of hydrates in the gas, to safely load gas from the pipeline to one or more bladder-equipped tube-trailers. The filled vessels will proceed to one or more re-fuel stations to deliver the natural gas into storage vessels.

The second terminal is built at each re-fueling station consisting of one or more un-loading manifolds connected to multiple storage vessels. A master meter will measure the amount of gas that is delivered from the delivery trailer and a hydraulic fluid content monitor will verify that the gas has not been contaminated during transport or while un-loading. During the un-loading operations, the master valve on the steel vessels containing an internal bladder will be opened to the storage vessel's distribution system and the pressures allowed to equalize without any external forces (compression). Once the pressure in the bladder is the same as the pressure in the storage vessels, flow will cease. At this point, a centrifugal pump will be activated to pressure-up the annulus between the bladder and the walls of the steel vessel, building up the pressure above the pressure in the storage tank which will require the walls of the bladder to move toward the area of lower pressure (i.e., the opening to the storage vessels) thereby squeezing gas out of the bladder into the storage vessels. The process will continue as long as the pump pressure is greater than the gas pressure inside the bladder and will be shut down when the discharge meter indicates the bladder is essentially empty. A check valve on the storage conduit will prevent back flow toward the meter and the bladder.

The hydraulic fluid pumping arrangement is made fail-safe by a maximum pressure switch (to shut down the pump if the set pressure is reached), however, in normal operations, the centrifugal pump will be designed so that the set pressure will not be exceeded.

The transport vehicle, whether it is an over-the-road truck, a railroad car, a barge, or even an aircraft, carries a specially designed manifold system to facilitate loading and un-loading of the natural gas quickly and with safety.

It has been found that in off-loading natural gas at relatively high pressure-differentials between the transport vessels and the storage vessels, hydrates (frozen water vapor) can form in the gas that are undesirable. The invention contemplates that line-heating equipment to prevent the formation of hydrates will be provided.

It is the principal object of the present invention to provide a method and system for economically transporting natural gas from a pipeline to a re-fuel station, or other end-user facility, without the need for high-pressure compression equipment to un-load the transport vessels; or without refrigerated pressure vessels or the need for constructing the usual feeder pipeline directly to the re-fueling station.

Another object is to provide a method and system for transporting natural gas over-the-road between a pipeline and a re-fuel station by use of a motor vehicle, designed to insure delivery of the natural gas in a condition satisfactory for use as a motor fuel.

Another object is to provide a method and system that not only is useable with over-the-road trucks, as a transport vessel, but which also is adaptable to other transport vehicles like railroad cars, barges, and airplanes, and which insures more efficient use of such other vehicles than in the past.

It is also an object to provide a hydraulic fluid system (fluid, pump, motor, surge tank, conduit) to off-load gas from a bladder-equipped transport vessel, designed to be fail safe in use, and to eliminate the type of problems (and associated extra costs) that could be incurred if the bladder were to be emptied by compressed air, or if the transport vessel did not contain a bladder and had to be evacuated using a suction compressor.

Yet another object of the invention is to provide a vehicle manifold system for a transport vehicle carrying one or more plurality of pressure vessels, designed to ensure the quick and safe filling and emptying the pressure vessel with natural gas.

A further object is to provide a system for gathering natural gas at a well-head and off-loading the gas at a pipe-line or re-fuel facility, or other end-user facility.

Other objects and many of the attendant advantages of the present invention will become apparent from the following Description of the Preferred Embodiment, when taken in conjuntion with the accompanying drawings.

DESCRIPTION OF THE PREFERRED EMBODIMENT

The method and system of the present invention are especially effective for economically transporting natural gas over-the-road by motor vehicle, from the first terminal to the second. Hence, it is the embodiment of the invention that is described in detail herein.

However, it is to be understood that the present method and system can also be utilized with other transport vehicles, and their associated terminals. The choice of a transport vehicle can include motor trucks, railroad cars, barges, aircraft, and the like, or even a combination of these. In each instance, the loading and off-loading method and system will function in the same manner and a maximum pay-load will be carried by the low-pressure, hydraulic fluid evacuated, vehicles, with less weight and space requirements than high-pressure, compressor-evacuated, vessels, and with less weight and space requirements for the refrigeration and insulation equipment necessary to transport the equivalent amount of liquified natural gas.

Given this explanation, it is understood that where a truck terminal is referred to herein, it might instead be a railroad terminal, or a terminal established to handle barges or aircraft. Similarily, the pressure vessels might be carried by some transport vehicle other than a motor truck. At the same time, it is again emphasized that the invention is especially useful for over-the-road transport of natural gas.

The value of the invention for over-the road transport flows from several features thereof. First of all, by eliminating the need for compressors to evacuate gas from the pressure vessels, the savings from the initial cost and operating costs will enable the lesser pay-load of a low-pressure vessel to be competitive with the cost of gas delivered by a high-pressure vessel. Further, the method and system of the invention provide for the safe and effective handling of the natural gas at re-fuel stations, utilizing relatively un-trained personnel who will be off-loading the vehicle into storage with high-pressure hydraulic fluid instead of evacuating the vessel with high-pressure gas compressors. In addition, the method and system make it possible to use semi-trailer carried pressure vessels, similar to those already in use to handle specialty gases (including natural gas), with limited modification to add an interior bladder to maintain separation of the gas and the hydraulic fluid pumped into the annulus of the vessel to evacuate all gas remaining in the vessel after pressure equalization with the storage vessel.

Figure 1:
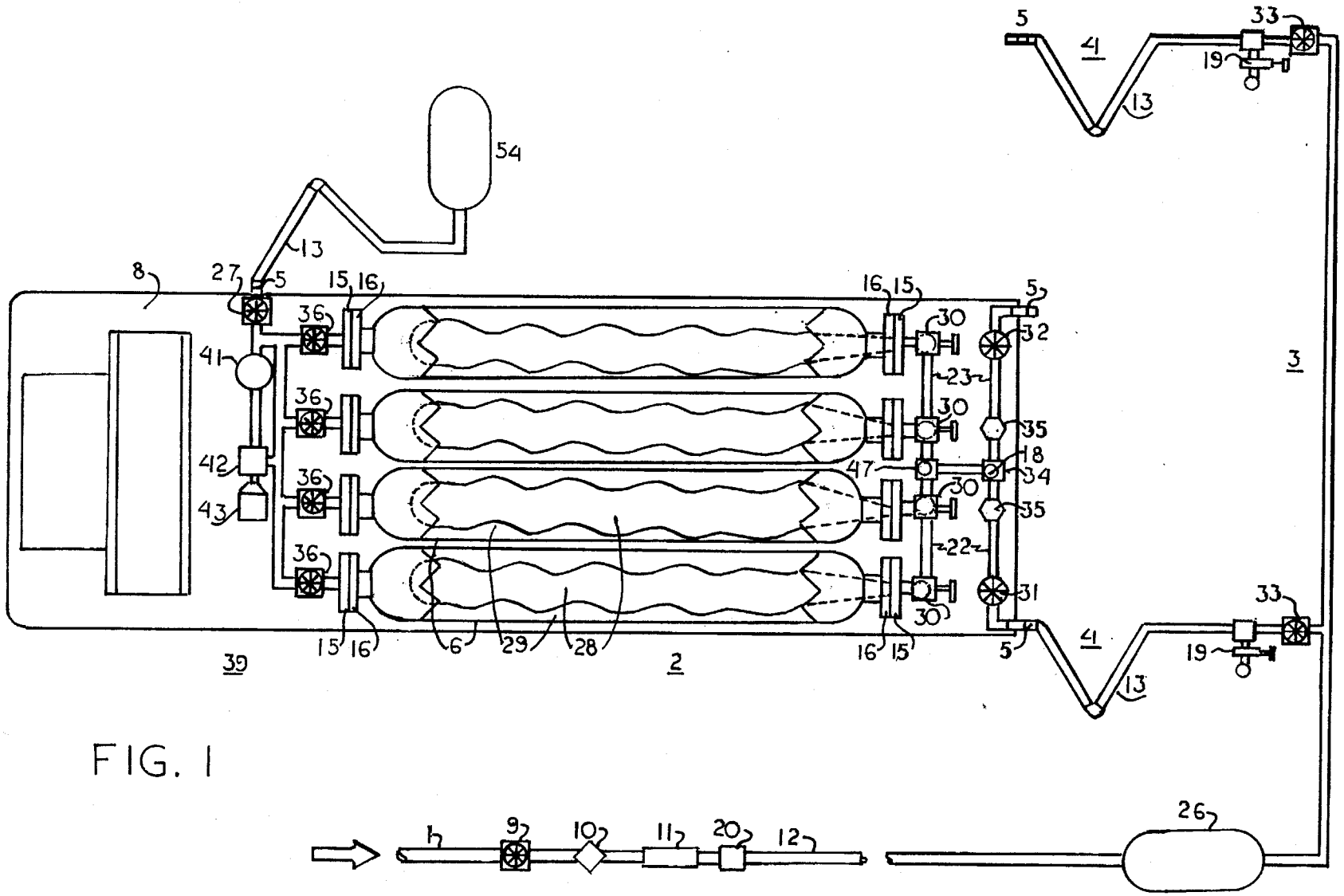
FIG. 1 is a diagrammatic view of the first terminal located at the pipeline outlet end of the invention.

Referring now to the drawings, a first terminal, located at a pipeline (1) exit site, is indicated generally at (2) in FIG. 1, and includes a loading manifold (3) having two truck loading stations (4). The terminal (2) is arranged to load natural gas under pressure into the tube-type pressure vessels (6) of semi-trailer motor vehicle units (7) which are designed to be drawn by a motorized cab (8) in the usual manner. While the loading manifold system (3) is shown arranged to handle two semi-trailers, it is understood that the system could be enlarged, if desired, to handle a greater number of units.

The loading process will be commenced by opening the pipeline valve (9) immediately up-stream from a check-valve (10). Also shown on FIG. 1, immediatley down-stream from the check-valve (10) is a sales meter (11). The pipeline valve, check-valve, and sales meter are the property of the pipeline company and are not a part of this system. Gas obtained will go through the master valve (9) and check-valve (10), through the sales meter (11), through the steel conduit (12), through the line-heater (26) and to the loading manifold (3). At the loading manifold (3), the gas stream is diverted to each semi-trailer motor vehicle (7) through individual conduits (13), which may be flexible hoses or rigid pipes, coupled to a loading manifold (22), which is connected to control valves (30) on the face of the companion flanges (15) which matches the flanged outlets (16) on each pressure vessel (6). Loading of each pressure vessel (6) will be accomplished by opening the individual control valves (30) on the face of the companion flanges (15) which will allow gas to pass through an opening in the flanges (15) to the backside of the flanges (15) where the opening in the flanges (15) is bonded so as to seal-off the opening through the flanges (15), by attaching the opening of the bladder (28) directly to the face of the flanges (15). The gas will pass into the opening of of the bladder (28) which will expand the bladder (28) to the steel walls of the pressure vessel (6) and, as more gas is inserted, the bladder will conform to the walls of the pressure vessel (6). At such time as the pressure gauge (18) on the loading manifold conduit (22) indicates that pressure in the pressure vessels (6) has equalized with pressure in the pipeline (1), flow will have ceased and the individual control valves (30) will be shut. Closing the individual valves (30) on each pressure vessel (6) will enable the gas trapped between the pressure vessel (6) and the master valve (33) to be bled-off through a bleed-off valve (19), thereby evacuating the loading manifold (3) in order to disconnect the quick connect-disconnect coupling (5) in preparation for an over-the-road trip to a re-fuel station.

If desired, pipes with suitable swivel-joints can be substituted for the flexible hoses (13). The choice of flexible hoses, or tubing, or relatively-rigid pipes, can depend upon the location of the terminal and other factors. At the termination of loading operations, the sales meter (11) will provide a record of gas sales. The chromatograph (20) will provide an analysis of the gas delivered to the pressure vessels (6) during fill operations.

Figure 2B:
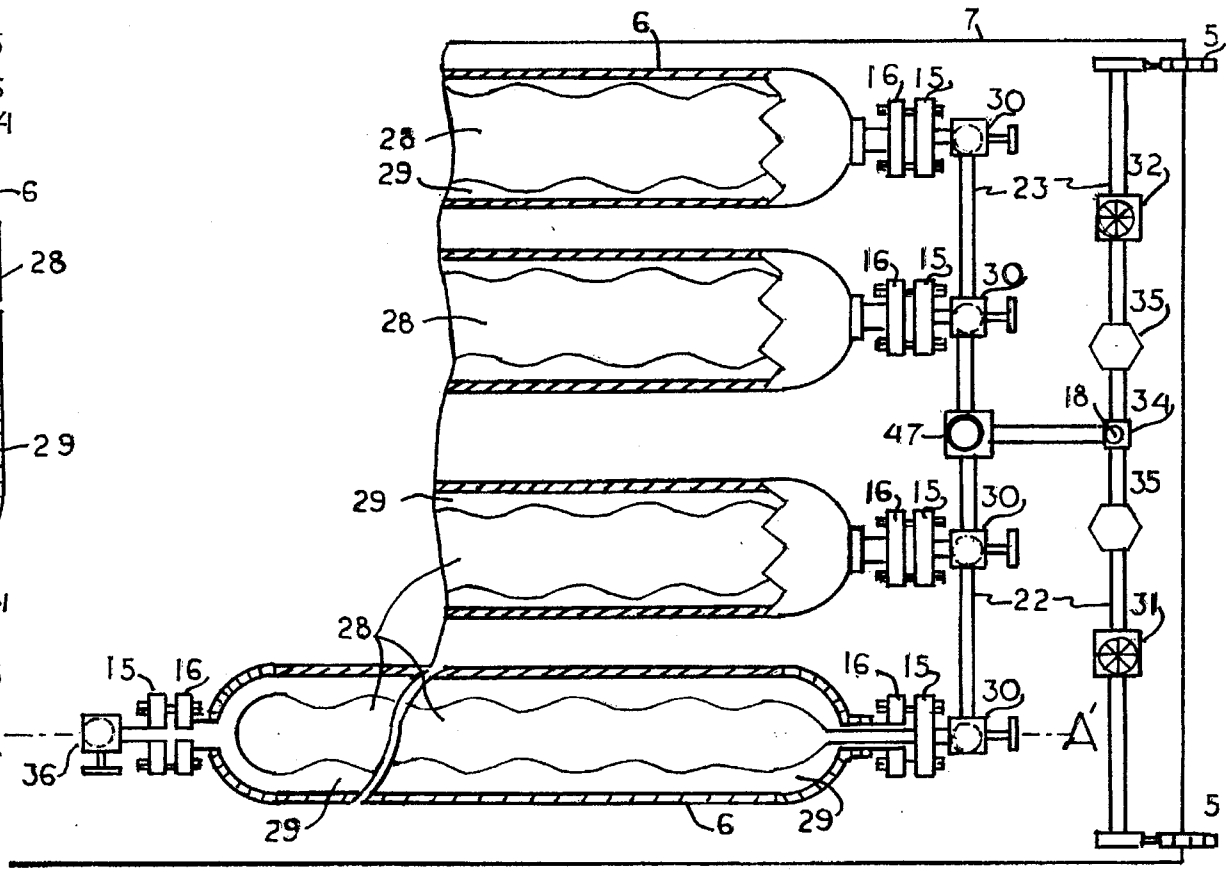
FIG. 2B is an enlargement view (top) of a portion of a typical transport trailer with four typical cylindrical steel vessels with internal bladders in place.
Figure 2A:
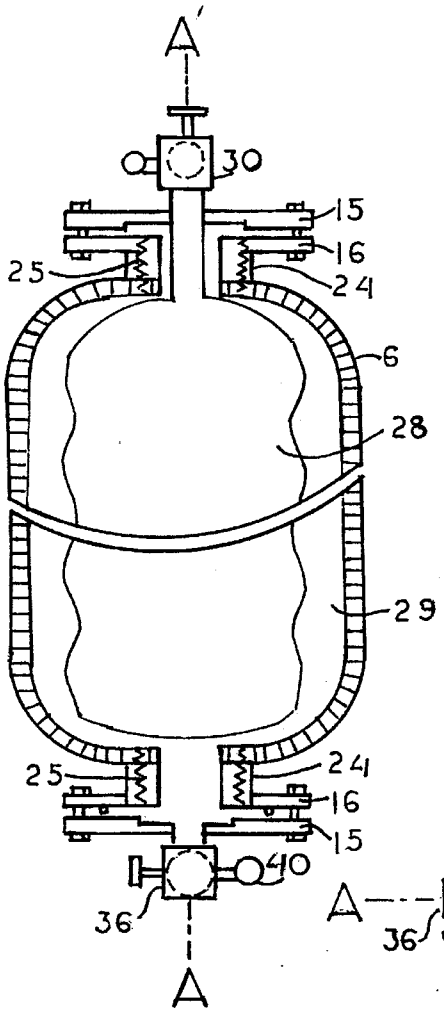
FIG. 2A is an enlargement view (top) of a typical pressure vessel showing that it is a cylindrical steel vessel.

Turning now to FIGS. 2A and 2B, the semi-trailer (7) has a plurality of the cylindrical pressure vessels (6) mounted thereon, the number actually being employed being a matter of choice. Indeed, in some instances, only a single pressure vessel (6) might be employed. The vehicle loading system (22) is mounted on the rear-end of the semi-trailer and is especially designed to handle the loading of natural gas. A similar vehicle un-loading system (23) will handle the un-loading of gas to storage. Diverter valve (31) will be open during loading, and closed during un-loading operations. Divefret valve (32) will be closed during loading and open during un-loading operations. The loading manifold (22), disposed across the rear end of the pressure vessel (6), is connected to the outlets of the pressure vessel (6) which have threaded outlets (24), and have in place a threaded nipple (25) to which threaded flanges (16) are attached on both ends. The companion flange (15) on the loading end provides the base on which an internal bladder (28) is attached, and is the means by which natural gas is isolated from the annulus (29) between the bladder and the steel walls of the vessel (6), which annulus (29) will be flooded with hydraulic fluid, under pressure, to squeeze gas out of the bladder and into storage vessels (44) at the re-fueling site (45). The companion flange (15) is connected to a control valve (30) of conventional construction, which is further connected to the vehicle loading system condit (22). Thus, each pressure vessel (6) can be individually loaded with natural gas, and off-loaded individually, if necessary, by operating it's associated diverter valve (31) or (32).

The loading manifold system (3) has one end of the vehicle loading system conduit (22) connected thereto, the other end of said loading conduit (22) having a T-branch fitting (34) thereon. The loading conduit system (22) is connected to one side of the T-branch fitting (34) and the off-loading system (23) is connected to the other side of the T-branch fitting (34).

The loading conduit system (22) has a flow-control valve (33) on one end, and a bleed-valve (19) at it's other end. Between the loading diverter valve (31) and the master valve (33) is an inlet stub carrying half of a quick connect-disconnect coupling (5), which coupling half is designed to mate with the coupling half carried by the flexible hose (13). The purpose of the bleed valve (19) is to allow all gas pressure to be drained from the vehicle loading system (22), before the coupling halves (5) are disconnected.

Disposed between the flow control valve (31) and the T-branch fitting (34) is an adjustable choke (35) which is used to regulate the rate of gas fill to help prevent the formation of hydrates (frozen water) which may occur if the pressure differential between the pressure vessel (6) and the pipeline (1) is too high. In the event hydrate formation occurs, even when the choke reduces the fill rate, the line heater (26), as shown in FIG. 1, can be utilized to heat the gas during withdrawals from the pipeline.

Figure 3:
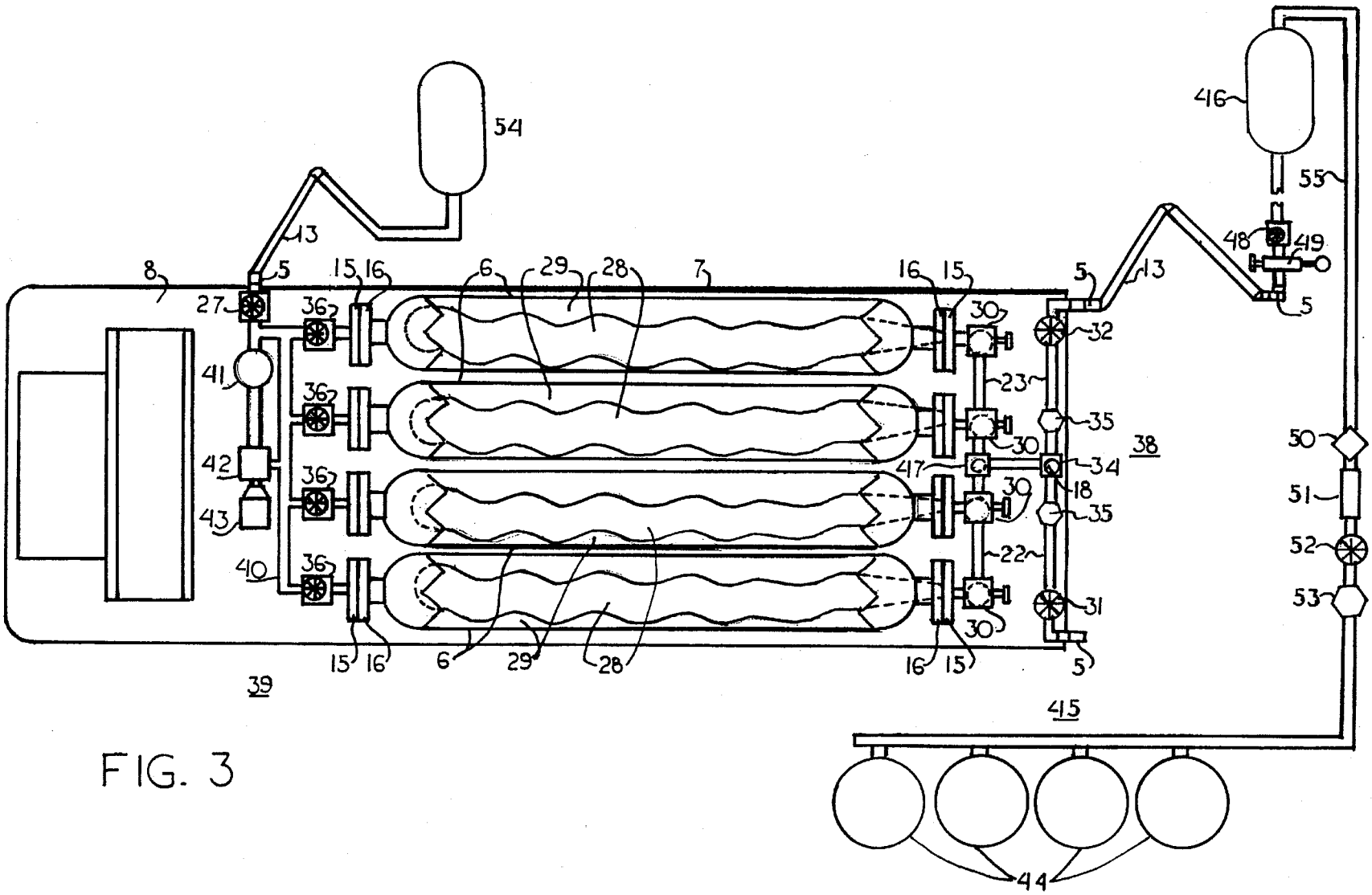
FIG. 3 is a diagrammatic view (top) of a second terminal installation located at the re-fueling site, or other end-use location.

Turning now to FIG. 3, the second terminal of the system of the invention is shown generally at (37) and includes the un-loading manifold (23), also as shown in an enlarged view in FIG. 2. The gas off-loading system (38) consists of two major components, that portion of the system wherein gas from the pressure vessel (6) flows to a storage vessel (44) by pressure equalization, and that portion of the system whereby the flow of gas out of the system's pressure vessels (6) is accomplished by displacement with hydraulic fluid. The key item is the separate hydraulic fluid—assisted un-loading system (39) consisting of a flexible bladder (28), an enlargement of which is shown in FIG. 2, which has the same interior volume as the interior of the pressure vessel (6), and when filled with gas during the filling process, will inflate and conform to the shape of the pressure vessel (6). The gas will remain in the bladder (28) during transit from the pipeline (1) exit site to a re-fueling station (45). During off-loading operations, a hydraulic fluid assistance manifold (40), located on the front end of the semi-trailer (7) will receive pressurized fluid from the surge tank (41) through a centrifugal pump (42), driven by an electric motor (43), which is connected by the fluid assistance manifold (40), through control valve (36) on each pressure vessel (6), to the annulus (29) between the outside of the bladder (28) and the inside walls of the steel pressure vessel (6). As soon as the gas pressure inside the bladder (28) has been reduced due to pressure differential toward the storage vessel (44) and pressures become equalized, flow will cease as reflected by the sales flow meter (51). At that time, the centrifugal pump (42) will commence to pump hydraulic fluid into the annulus (29) which will commence to deflate the bladder (28) which in turn will force gas out of the bladder (28) into storage (44). When the sales flow meter (51) indicates that essentially all gas has been evacuated from the inside of the bladder (28), the pump would be shut down and hydraulic fluid pressure bled off through the bleed valve (27) back to the surge tank (41). The bladder (28) and the annulus (29) have then been de-pressurized for the return trip to the pipeline (1) exit site for re-loading.

The present invention contemplates transporting natural gas, in the pressure vessels (6), at a pressure in excess of 1000 psi, and usually in the range of 1100–1500 psi. Where pipeline pressure is below this level, the pressure vessels (6) would be filled at whatever pressure is available and will be off-loaded, utilizing the hydraulic fluid—assisted system (39), at whatever pressure is necessary to exceed the pressure in the storage vessels (44) at the re-fuel station (45). The pressure relief valve (47) is intended to provide emergency relief to the gas transport system (4). Also shown on FIG. 3 is an auxilary hydraulic fluid tank (54) to provide additional hydraulic fluid, if necessary for un-loading operations.

The method of the invention includes the steps to take natural gas from a pipeline; loading the compressed gas into a bladder inside a pressure vessel means mounted on a semi-triler for transportation, by motor vehicle; transporting the pressure vessel with the compressed gas therein in the bladder, at ambient temperature, to a re-fuel station, or other end-user, terminal location; off-loading the compressed gas through the conduit means, by pressure equalization, augmented, as necessary, by deflation of the internal bladder with pressurized hydraulic fluid. By transporting the natural gas at the indicated low to moderate pressures, and under ambient temperature conditions, the use of heavy and space-occupying compression equipment as required by U.S. Pat. Nos. 4,139,019, 4,413,476, and 4,380,242 is eliminated. Also, the use of heavy and space-occupying refrigeration and insulation equipment as required to transport liquified natural gas as indicated in U.S. Pat. No. 3,232,725 is eliminated, with the result that natural gas can be economically transported over-the-road to supply natural gas to re-fuel station requirements.

The manner in which the loading system of FIG. 1 functions to carry out the first portion of the method is believed to be evident from the above description thereof. In order to load a semi-trailer unit (7), such is first placed at one of the loading stations (4) and the coupling halves (5) are then joined. The master control valve (33) and the individual valves (30) are opened, and then the pipeline valve (9) is opened to begin the flow of gas to the transport vessel (6). After the pressure vessels (6) are filled, the individual control valves (30) are closed. Thereafter, the main divefret valve (33) is closed to terminate the supply of natural gas and thereafter the bleed valve (19) is opened to relieve pressure on the loading manifold system (3). The quick connect-disconnect coupling (5) is then disconnected and the loaded semi-trailer is ready for transport.

Turning now to the second terminal, the gas off-loading site (37), gas off-loading operations are carried out as follows. The rear of the transport semi-trailer (7) is positioned so that the vehicle un-loading manifold system (23) is in close proximity to the un-loading conduit (55) and connection therewith is made with a flexible un-loading hose (13) which may be the same hose used to load the vehicle or a similar hose, utilizing quick connect-disconnect couplings on both ends. Control valve (30) and the un-loading divefret valve (32) are then opened and thereafter flow is controlled by the adjustable choke (35). Flow is through the line-heater (46) which can be activated to heat the gas, if necessary, to prevent the formation of hydrates. As the natural gas flows, by pressure differential, from the semi-trailer (7) to the storage vessels (44), the pressure will equalize and it will be necessary to evacuate the remaining gas from the bladder inside the pressure vessel (6) by pumping hydraulic fluid into the annulus (29) to deflate the flexible bladder (28).

When off-loading is completed, the valves (30) and (32) will be closed, along with valves (48) and (52) which are valves whose primary function is to isolate that portion of the off-loading system from the bleed valve (49) through the off-loading conduit (55), through the line heater (46), the sales meter (51) and hydraulic fluid monitor (50), so that this portion of the off-loading system can be maintained in a pressurized condition during the time that un-loaded vehicle (7) is replaced with another filled vehicle (7) for un-loading. Thereafter, the bleed valve (47) and the un-loading diverter valve (32) will be opened to relieve any pressure on both sides of the quick connect-disconnect coupling (5), and then the coupling will be disconnected. A check-valve (53) is located downstream from the master valve (52) to prevent back-flow from the storage tanks (44). Also shown are the gas sales meter (51) and the hydraulic fluid monitor (50) which will verify volumes delivered at the re-fueling stations and verify that hydraulic fluid had not come in contact with the gas during transport or off-loading.

It is believed apparent from the above how the present method and system can be adapted for use with other kinds of transport vessels, and other kinds of vehicle terminals. The method of the invention remains the same, the equipment is substantially identical and functions in the same manner, regardless of the kinds of transport vehicles a terminal utilizes.

The present method and system fulfill all of the objects set forth hereinabove for the invention, and make it the best possible way to economically-transport natural gas from a pipeline to an automotive re-fuel station, and other end-users. Thus the availability of natural gas, the environmentally-preferred fuel for automobiles, trucks, and busses, can be such that it can economically compete with gasoline and diesel for automotive fuel use. In addition, the increased use of natural gas as the primary fuel for automobiles, trucks, and busses, will open further opportunities to reduce the amount of crude oil used to make gasoline, which, in turn, will reduce the reliance on foreign crude oil as the primary source of domestic energy requirements. The reduced reliance on foreign oil imports could have a major favorable impact upon the United States' adverse balance-of-payments and a major beneficial effect upon the U.S. budget, and long term debt.

Obviously, many modifications and variations of the present invention are possible. Further, it is evident that the invention's use of a flexible bladder and a hydraulic fluid—assistance method contributes greatly to the economics of transporting natural gas from a pipeline to a re-fuel station.

The invention claimed is:

1. A system for transporting natural gas from a natural gas pipeline exit location to an end-user location comprising:

a pressure vessel means having at least one pressure vessel mounted to a transport vehicle, a vehicle manifold means and a vehicle coupling means in fluid communication with said vehicle manifold means, wherein said at least one pressure vessel comprises a steel vessel with an internal bladder adapted to contain natural gas;

a first terminal located at said natural gas pipeline exit location having a means for receiving natural from a natural gas pipeline and a loading manifold means fluidically connected to a loading coupling means being releasably connectable to said vehicle coupling means;

a second terminal located at said end-user location having a natural gas off-loading manifold means for supplying natural gas to a natural gas storage vessel located at said end-user location, a natural gas off-loading conduit means fluidically connected to a natural gas off-loading coupling means being releasably connectable to said vehicle coupling means for off-loading natural gas from said at least one pressure vessel and a heater means disposed in fluid communication with said natural gas off-loading manifold means to prevent, if necessary, the formation of hydrates therein; and a hydraulic fluid off-loading assistance means connected in fluid communication with said pressure vessel means being adapted to be connected to a source of hydraulic fluid remotely disposed from said transport vehicle and being arranged to pump said hydraulic fluid into an annulus formed between said steel vessel and said internal bladder, wherein after pressure equalization between said at least one pressure vessel and said natural gas storage vessel, the hydraulic fluid off-loading assistance means collapses the internal bladder and thereby squeezes natural gas from a containment space formed by the internal bladder.

2. A system according to claim 1, wherein said hydraulic fluid off-loading assistance means further comprises:

a source of hydraulic fluid remotely disposed from said transport vehicle;

a hydraulic fluid manifold means adapted to be coupled to said source of hydraulic fluid and convey said hydraulic fluid to said annulus via at least one conduit means; and a motor driven pump for conveying hydraulic fluid to said hydraulic fluid manifold means from said source of hydraulic fluid.

3. A system according to claim 2, wherein said at least one pressure vessel and said at least one conduit means are connected via a pair of companion flanges.

4. A system according to claim 1, wherein said transport vehicle is a motorized truck.

5. A system according to claim 1, wherein said vehicle manifold means comprises a T-branch fitting with defines separate loading and unloading conduits.

6. A system according to claim 1, wherein said end-user location is an automobile refueling station.

* * * * *